United States Patent [19]

Dysarz

[11] Patent Number: 4,683,832

[45] Date of Patent: Aug. 4, 1987

[54] DEVICE AND METHOD TO SET AND SALVAGE STRUCTURES

[76] Inventor: Edward D. Dysarz, 11423 Triola La., Houston, Tex. 77072

[21] Appl. No.: 636,102

[22] Filed: Jul. 30, 1984

[51] Int. Cl.[4] ..... E02D 25/00

[52] U.S. Cl. ..... 114/258; 114/44; 405/206; 405/209; 414/138

[58] Field of Search ..... 405/203, 204, 205, 209, 405/206; 114/45, 258–260, 44; 414/138, 477–479, 745; 212/190; 410/47, 50; 294/106

[56] References Cited

U.S. PATENT DOCUMENTS

| | | | |
|---|---|---|---|
| 2,901,201 | 8/1959 | Taylor et al. | 410/50 |
| 2,963,310 | 12/1960 | Abolins | 212/190 |
| 3,450,282 | 6/1969 | Ezolt | 414/477 |
| 3,633,369 | 1/1972 | Lawrence | 114/260 X |
| 3,895,592 | 7/1975 | King | 114/45 |
| 3,906,879 | 9/1975 | Lucht | 114/258 |
| 4,286,346 | 9/1981 | Wiek | 414/477 X |

*Primary Examiner*—Sherman D. Basinger
*Attorney, Agent, or Firm*—David M. Ostfeld

[57] ABSTRACT

An offshore marine structure setting and recovery device and method that can lift great loads offshore. The unit consists of a conventional deck cargo barge fitted with one or more rails running almost the entire length of the barge. A horizontal jacking unit runs along the rail or rails. Pivotally attached to the horizontal jacking unit is an inclined jacking unit that is connected to the grappling arm by a rack and pinion. The grappling arm has attached to it grappling devices that will grab and hold the vertical or inclined members of the marine structure. At one end of the grappling arm is a buoyancy tank that can be filled with either water or air to make the grappling arm and buoyancy tank float or sink. The device will be moved up to a marine structure, clamp itself onto the structure and then pull the structure over. The buoyancy tanks will then be filled with air, transporting the marine structure to the surface. The horizontal jacking unit will then pull the unit up and onto the deck of the barge. The barge will then transport the marine structure to shore. To set a marine structure offshore the same procedure will be used but in reverse order.

7 Claims, 25 Drawing Figures

DEVICE AND METHOD TO SET AND SALVAGE STRUCTURES

BACKGROUND OF INVENTION

1. Field of Invention

The present invention relates to setting and recovering of offshore marine structures by allowing buoyancy tanks to be placed at the bottom of marine structures and than pulling said structures on or off, of the deck of a barge thereby eliminating the need to use a barge and expensive derrick barge to move the structure into or out of the water. The present invention has been found to be particularly useful in the offshore construction and salvage art, and hence will be discussed with particular reference thereto. However, the present invention is applicable to other types of construction requiring moving, setting, salvaging and demolition of offshore structures.

2. Description of Prior Art

A derrick barge or a crane ship is a very useful and well used tool in the offshore industry for assisting in the construction of offshore structures. However, their lifting capacity is limited by weight lifting capacity, by the height of the structure being built and by the cost of the derrick barge or crane ship. To date the largest crane ship can lift about 4,500 short tons and is very expensive to operate.

To operate a crane ship, or derrick barge a deck cargo barge is also required to transport the jacket structure. This will also usually require several offshore tug boats.

To increase the capacity of a derrick barge or a crane ship the boom must be made stronger, the cables must be made of a larger diameter, the number of cables must also be increased and the winch must be made stronger. With the increased capacity of the boom, cables and winch a lot of structural steel must also be added to the crane and the vessel. The extra steel, cables, machinery etc., are added along the water line of the vessel thereby decreasing the stability of the vessel. When the stability of the vessel is decreased, the vessel itself must be enlarged. As the weight lifting capacity of a derrick barge or a crane ship is increased, the cost of the unit will increase exponentially.

As the operating criteria of production platforms is increased, so is the height and weight of the production platform increased. As the height and weight of the platform are increased the reach and weight lifting capacity of a derrick barge or crane ship must be increased. A derrick barge or crane vessel must reach out to the center and above the item to be lifted and is therefore at a great mechanical disadvantage when working either well below or a great distance away from the center of the platform.

Another method of handling offshore jacket structures is to use buoyant tanks that are attached to the sides of the structure by divers. This allows the structure to be removed from the operation site but the structure must be transported below the water with only the buoyant tanks at the surface. The problem with this method of jacket structure recovery is that the jacket structure is deep in the water and therefore cannot be taken into a harbor or port to be worked on. It is also good only for jacket structure salvage.

Several types of offshore platform construction method have been known and used before and typical examples thereof are shown in U.S. Pat. No. 3,442,340 May 6, 1969 issued to Lowell B. Christenson, U.S. Pat. No. 2,907,172 issued to Wilfred S. Crake Oct. 6, 1959; U.S. Pat. No. 4,041,711 issued Aug. 16, 1967 to Joseph E. Lucas. U.S. Pat. No. 3,138,932 June 30, 1964 issued to Darld C. Kofahl. None of these devices, however, teach either setting or salvaging offshore jacket structures that are widely used in the offshore industry.

SUMMARY OF THE INVENTION

The present invention is a highly efficient system and method to economically extend the weight lifting capacity of offshore construction and demolition operations thus allowing larger offshore structures to be set in place and later recovered at a lower cost. A conventional deck cargo barge has one or more rails running along its deck. A pulling and pushing device such as a horizontal jacking unit pushes or pulls itself along the rails. Connected to the horizontal jacking unit is an inclined jacking unit that moves the grappling arm. Further attached to the grappling arm are grapples that suitably attach to the jacket structure to hold the jacket structure. At the other end of the grappling arm is the buoyancy tank that allows the grappling arm to be horizontal or parallel to the surface of the sea when filled with air or perpendicular to the sea floor when filled with water.

To remove a marine structure from the sea floor, the buoyancy tank is filled with water allowing it to sink to where the grappling arms are parallel to the marine structure. The barge is pushed or pulled up to the marine structure allowing the grapples to be attached to the marine structure. When the grapples are attached to the marine structure the barge is pulled back thus pulling the marine structure over to where one end of the marine structure is resting on the barge and the other end is resting on the sea floor or the buoyancy tanks. The buoyancy tanks are filled with air and are allowed to float up to the surface of the sea. The horizontal jacking unit than pulls the grappling arms and the marine structure onto the barge. The barge is than towed to shore or some other location.

In the preferred embodiment the unit may be equipped with generators, hydraulic pumps, air compressors, control house, fuel tanks and hydraulic tanks.

BRIEF DESCRIPTION OF DRAWINGS

For further understanding of the nature and objects of the present invention reference should be had to the following detailed description of the preferred embodiment thereof, taken in conjunction with the accompanying drawings, in which like parts are given like reference numerals and wherein.

DETAILED DESCRIPTION OF THE PREFERRED EMBODIMENTS

Introduction

The preferred embodiment of the device and method of the present invention may be used to launch, set and salvage offshore marine structured in water depths from 5 feet to 2000 feet that weigh in excess of fifty thousand (50,000) tons. The great length and weight lifting and moving capacity is accomplished by the combination of a barge on the surface of the sea that is assisted by one or more grappling arms and one or more buoyancy tanks. A particularly important area of application of the present invention is in the recovery of marine structures, the setting of marine structures, the recovery and setting of platform caissons, bridge caissons and the recovery of sunken vessels. It should be realized that the present invention could be applied to for example any application where it is desired to set or recover heavy objects that are on the sea floor or any objects to be placed on the sea floor.

The preferred embodiment of the invention places more emphasis on the recovery of offshore structures but it is equally capable of setting structures on the sea floor.

The device and method of the preferred embodiment is assisted by a tug boat or it can be self propelled.

Device and it's Method of Use

Figure 1:
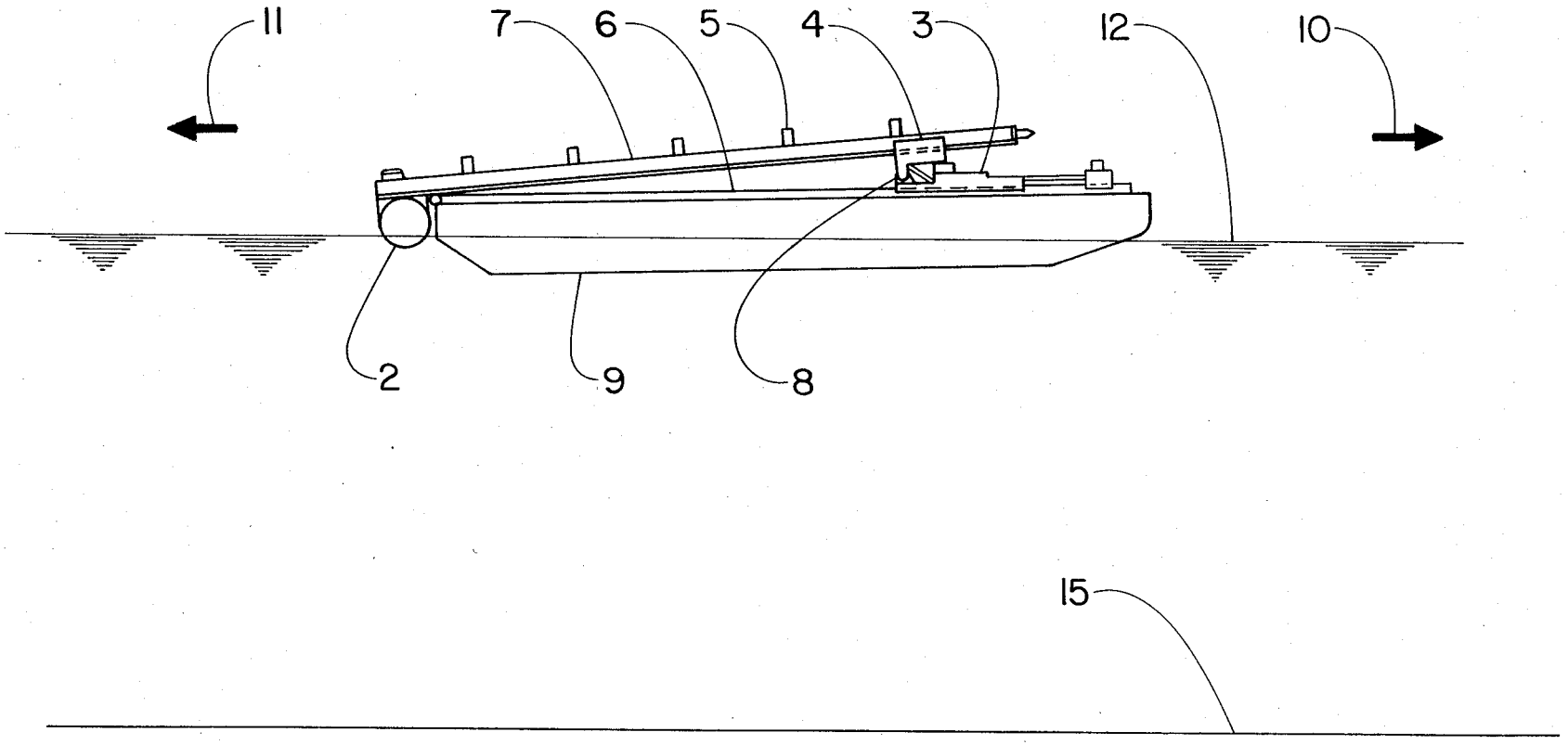
FIG. 1 is an elevation view of Embodiment 1 of the apparatus of the present invention.

As shown in FIG. 1 the preferred embodiments of the device 1 comprise of eight elements. Device 1 has one or more rails 6 that are suitably attached to barge 9 to allow the horizontal jacking unit 3 to move in the forward direction 10 or the aft direction 11. Attached to the horizontal jacking unit 3 by hinge 8 is inclined jacking unit 4. Attached to inclined jacking unit 4 by means of a rack and pinion not shown in this figure is grappling arm 7. Further attached to grappling arm 7 are the grapples 5 that are used to grab the production platform not shown in this figure. At the aft 11 end of the grappling arm 7 is a buoyancy tank 2 that is shown on the surface 12 of the sea with the barge 9.

Figure 2:
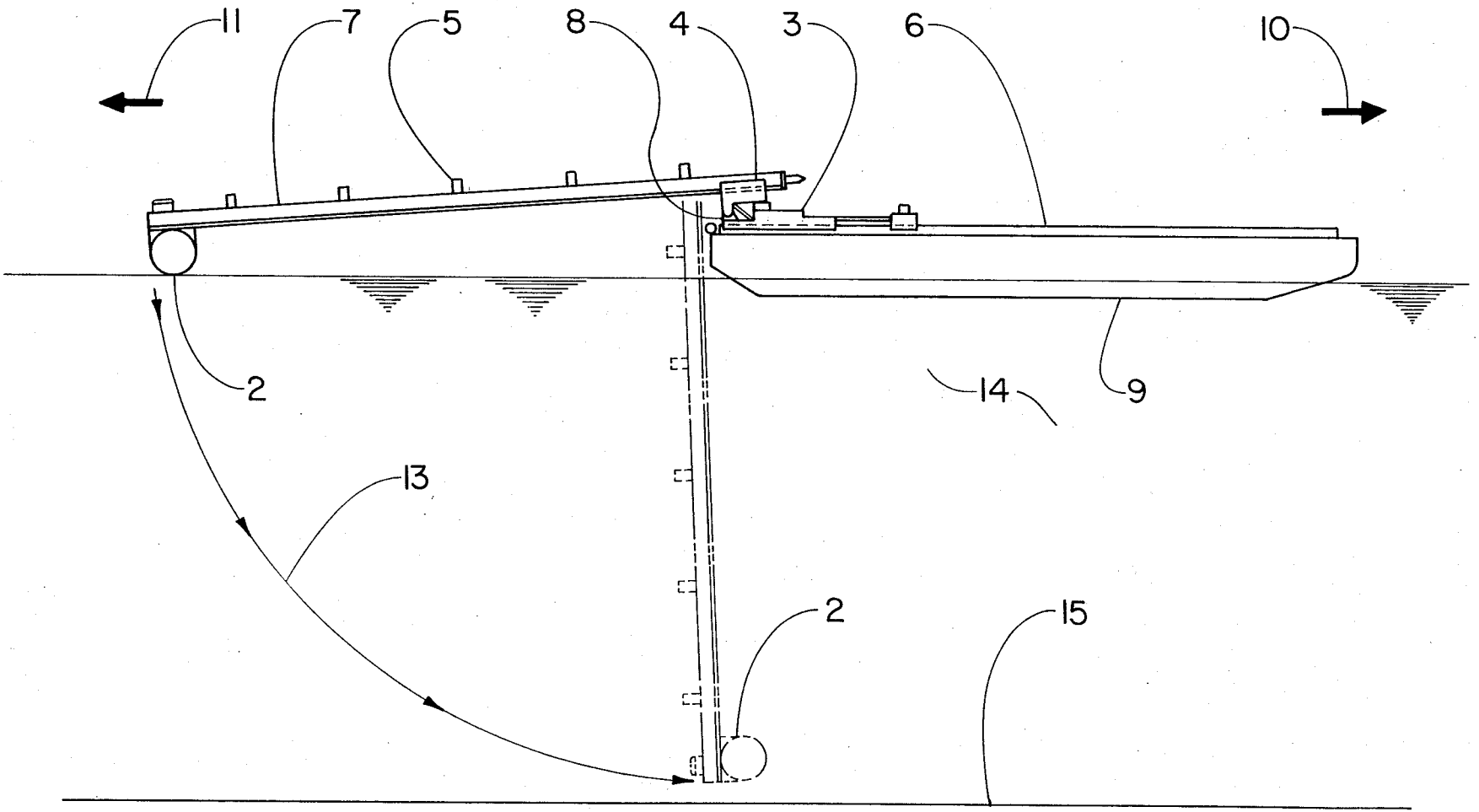
FIG. 2 is an elevation view of Embodiment 1 of the present invention showing the grappling arm extended away from the barge and rotated toward the sea floor.

Referring to FIG. 2 the preparations are made to remove the jacket structure 16 when barge 9 is pulled to the operations site by tug boats or other means not shown the horizontal jacking unit 3 is activated and moves in the aft 11 direction thus pushing the grappling arm 7 and buoyancy tank 2 into the water 14.

Air vent 120 will allow air to escape from buoyancy tanks 2 and valve 121 at the top of the air vent 120 is used to shut off the flow of air from the buoyancy tanks.

When the buoyancy tank 2 is flooded, it will sink into the water 14 to a position above the sea floor 15 where it will be guided to the marine structure 16 by cables not shown or directional thruster 18 and later will be set onto the sea floor 15. Buoyancy tank 2 will follow an arc similar to arc 13 as it falls under controlled conditions to a position near sea floor 15.

Figure 3:
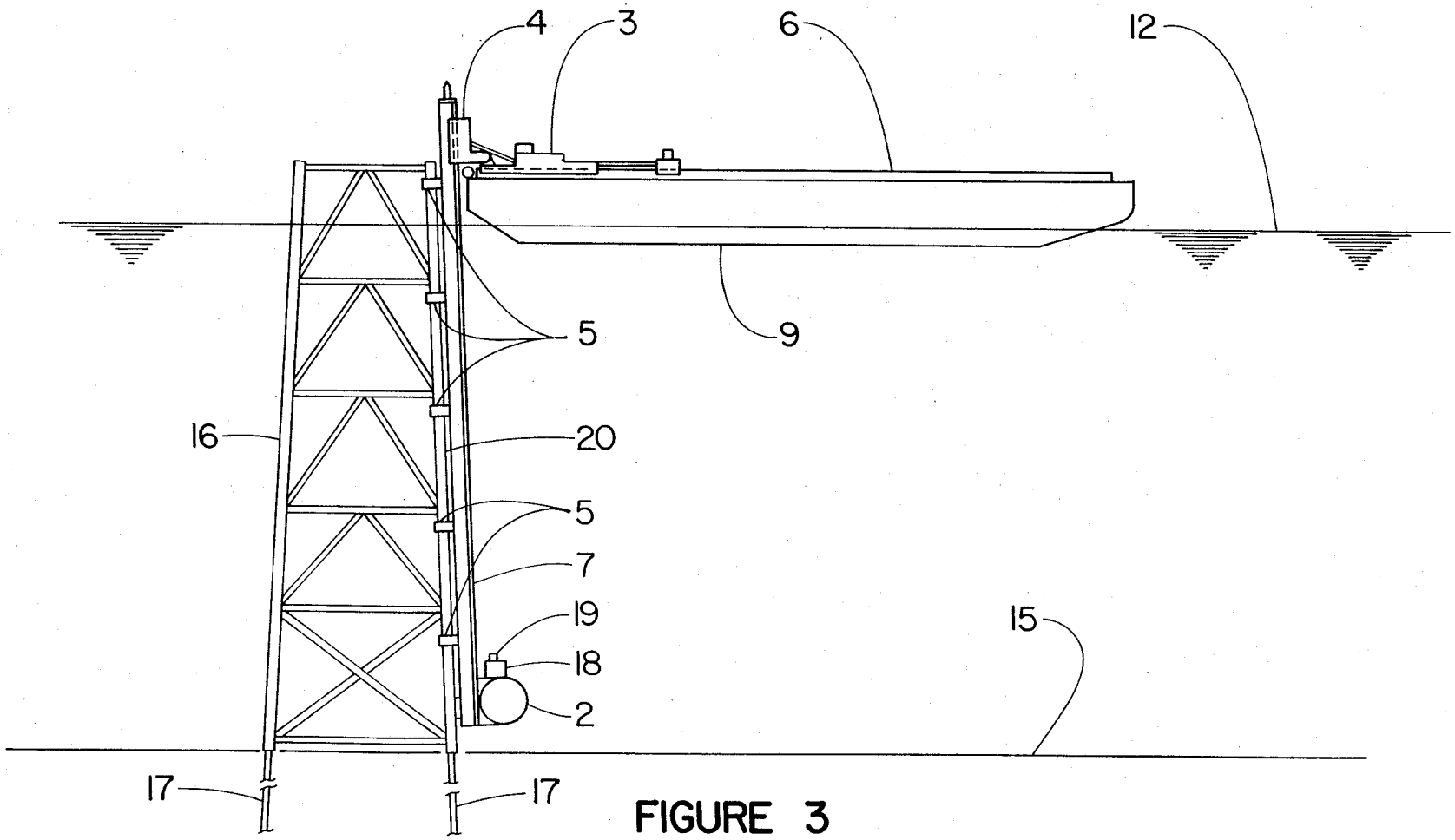
FIG. 3 is an elevation view of Embodiment 1 of the present invention showing how the grappling arm and the grapples are attached to the marine structure.

Referring to FIG. 3 the barge 9 has been pulled up to the marine structure 16 to allow grappling arms 7 to come close enough to vertical marine structural members 20 to allow grapples 5 to attach to vertical members 20 of jacket structure 16. To guide grappling arms 7 into vertical members 20 directional thruster 18 will move grappling arms in any desired direction. Mounted on top of thruster 18 is a television camera 19 or other devices to enable the view on the surface to observe and guide the grappling arm 7 to vertical jacket structural member 20.

Still referring to FIG. 3 before grapples 5 secure grappling arm 7 to vertical structural member 20, buoyancy tank 2 is lowered to sea floor 15 or near sea floor 15. Piles 17 are also cut by conventional means before or sometimes during removal.

Figure 4:
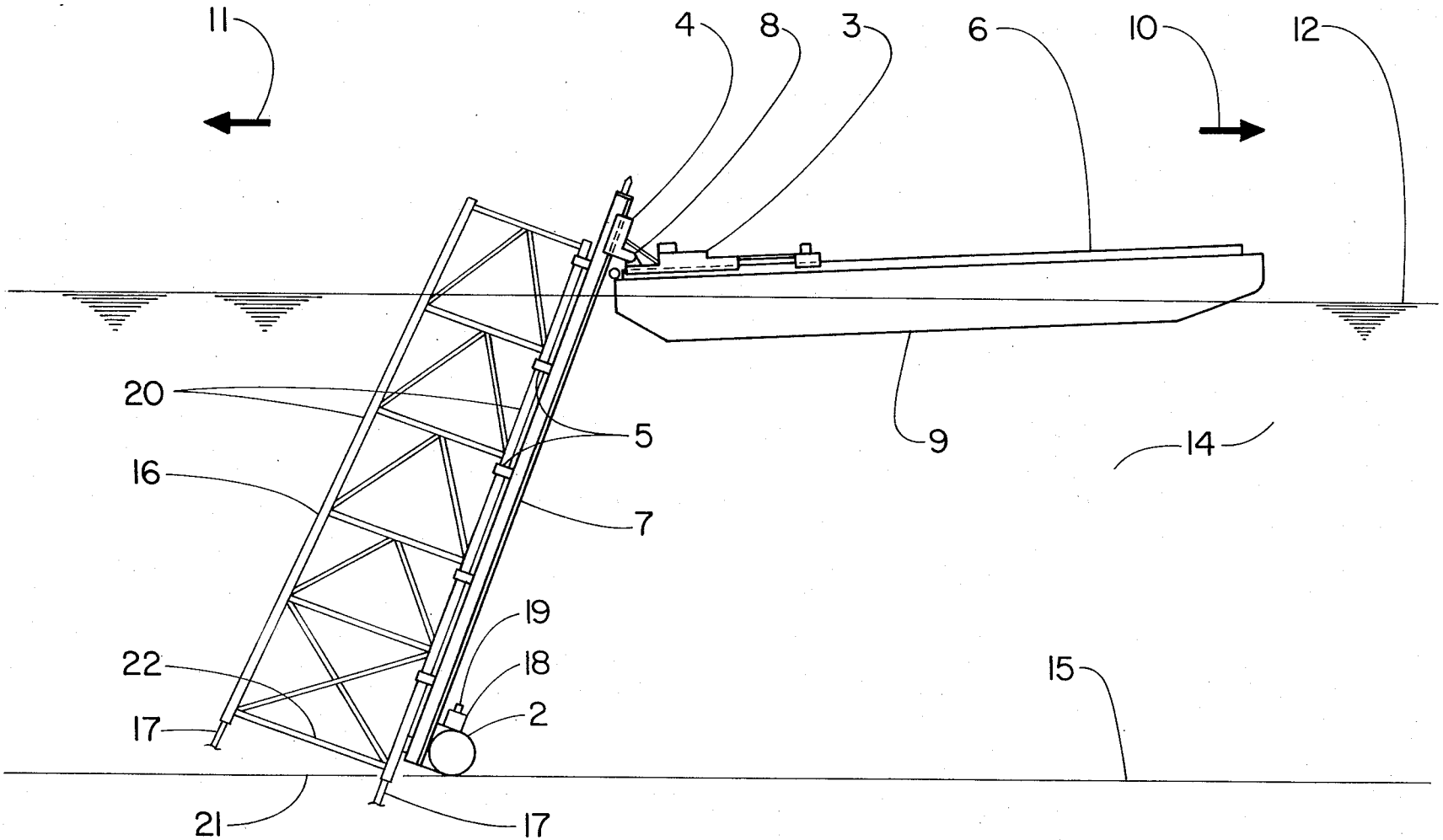
FIG. 4 is an elevation view of Embodiment 1 of the present invention showing how the marine structure is pulled over.

Referring to FIG. 4 when grapples 5 or other device have secured the grappling arm 7 to vertical marine structural member 20, the barge 9 is pulled in a forward 10 direction by a mooring system not shown or a tug boat not shown or some other suitable means.

When the marine structure 16 is pulled over to where buoyancy tank 2 is past the aft end of the barge 9 and the inclined jacking system 4 the buoyancy tank is ready to be filled with air.

The marine structure 16 is pulled over in this manner for two reasons. When the marine structure 16 is pulled over at an angle it is easier to break the suction between the mud 21 and the mud mat 22 on the marine structure 16.

Figure 5:
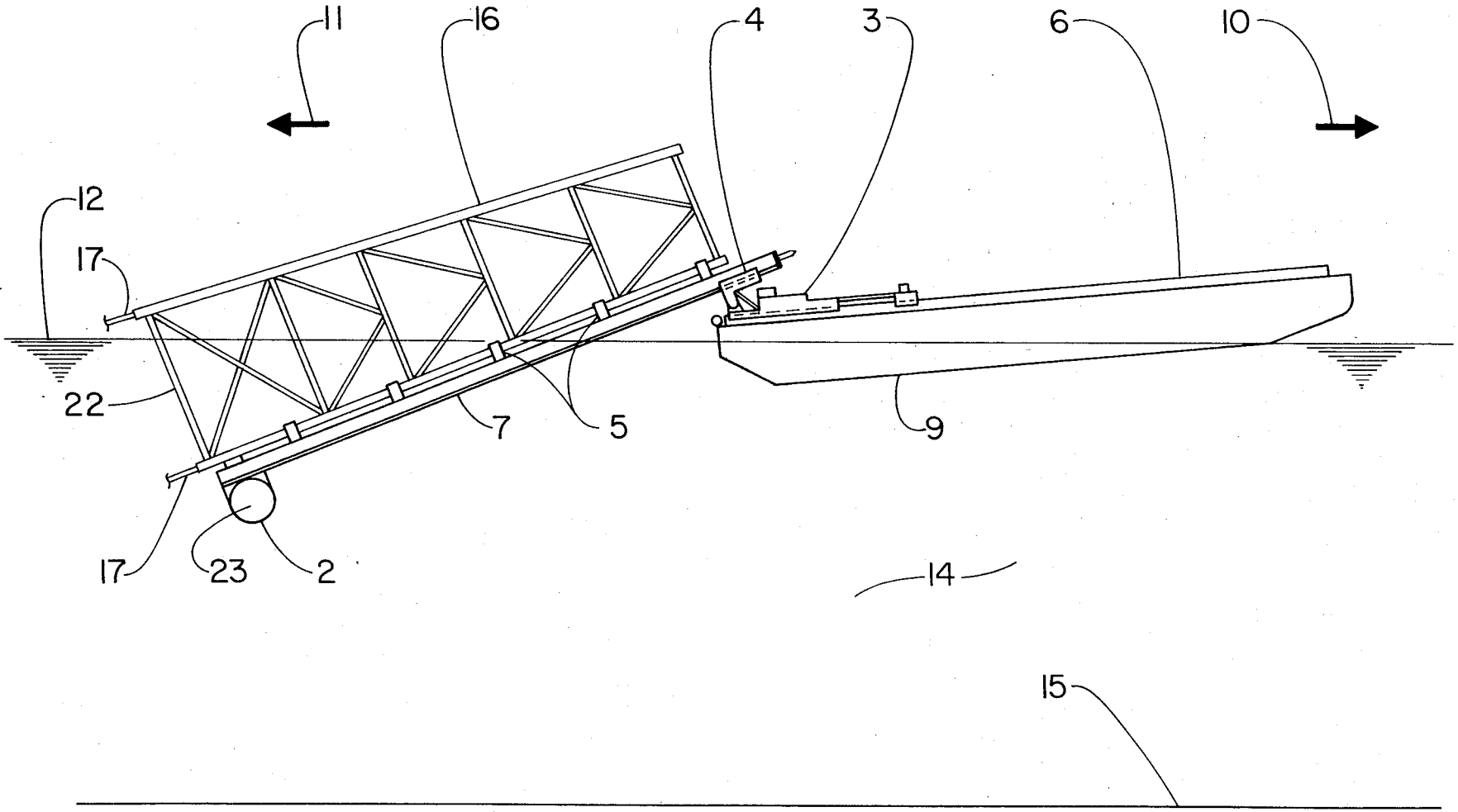
FIG. 5 is an elevation view of Embodiment 1 of the present invention showing the marine structure being lifted to the surface of the sea.

Referring to FIG. 5 as mentioned in FIG. 4 when the marine structure 16 is pulled over to a position where the buoyancy tank 2 is well to the aft 11 end of the barge 9 and inclined jacking unit 4, the buoyancy tank 2 is filled with air 23 and at the same time water 14 is pumped out causing the buoyancy tank 2 to lift the marine structure 16 to the surface 12.

At this point the marine structure 16 is ready to be pulled aboard the barge 9.

Figure 6:
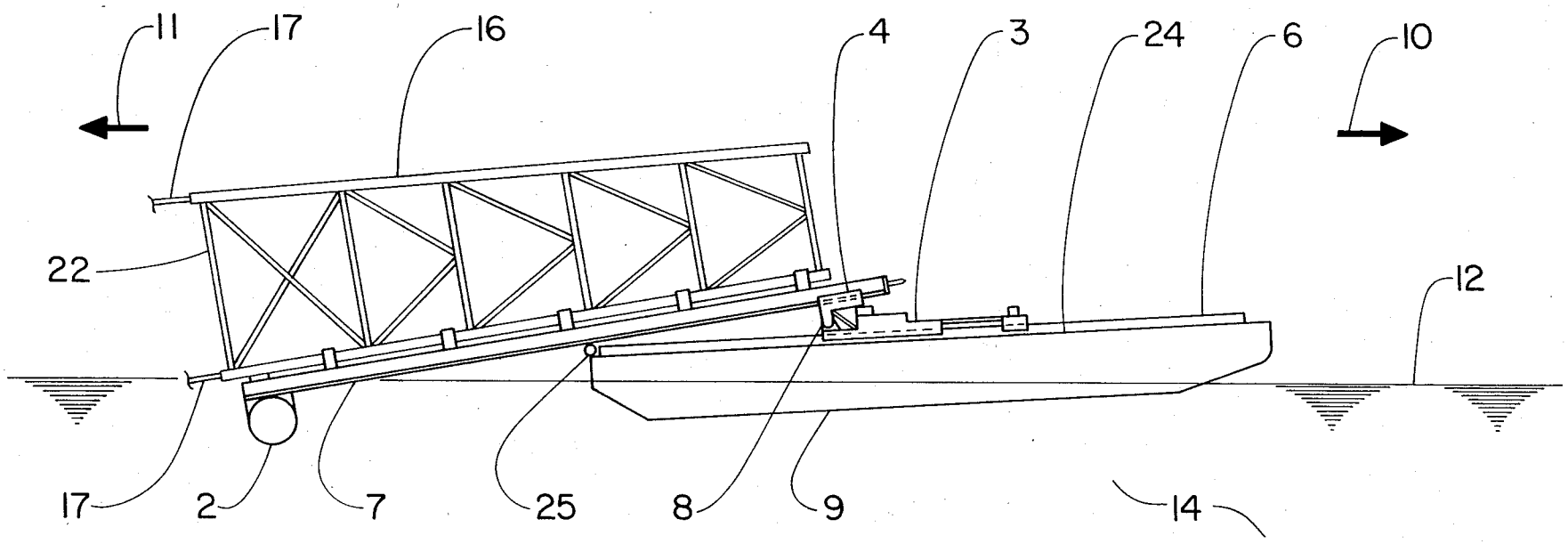
FIG. 6 is an elevation view of Embodiment 1 of the present invention showing the marine structure and grappling arms being towed up onto the barge.

Referring to FIG. 6 when the marine structure 16 is at the surface 12 as in FIG. 5 the horizontal jacking unit 3 is activated and starts to pull the grappling arms 7 with the marine structure 16 forward 10 and up on the deck 24 of barge 9.

As the grappling arm 7 and marine structure 16 are being pulled aboard the barge 9, the grappling arm 7 may rub on the barge 9. To prevent damage a roller 25 or other skidding device or other suitable device may be added as required.

Figure 7:
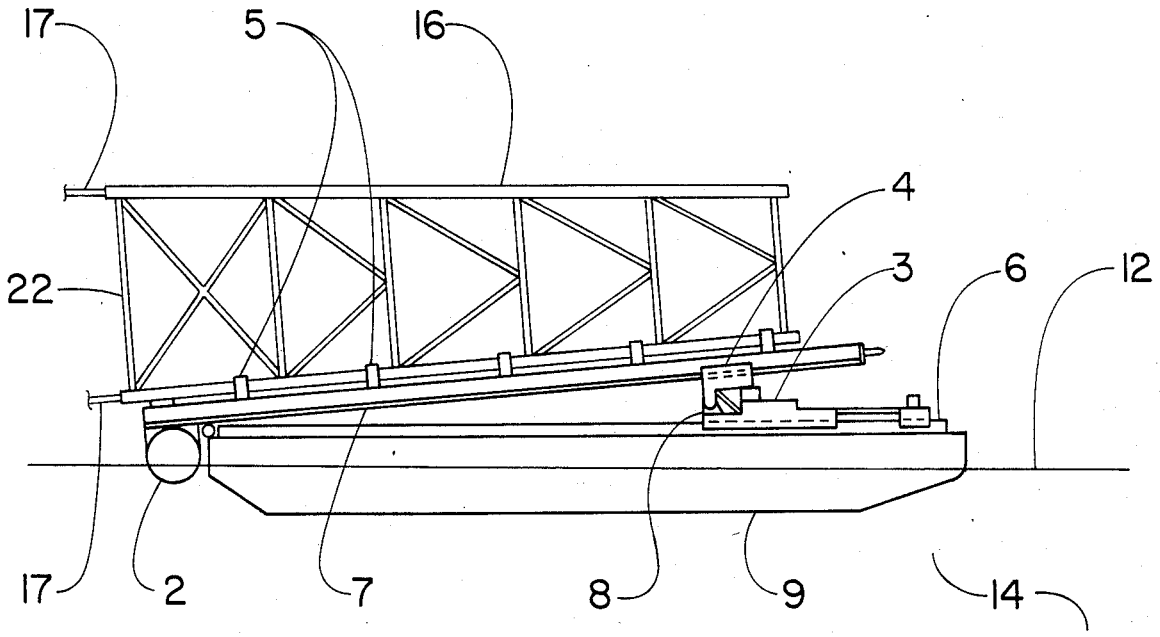
FIG. 7 is an elevation view of Embodiment 1 of the present invention showing the marine structure on the deck of the barge.

Referring to FIG. 7 which shows the marine structure 16 on the barge 9. This is as far up on the barge 9 as the marine structure 16 needs to be taken. The buoyancy tank 2 will assist in supporting the marine structure 16 in the water 14.

Not shown is a suitable locking device that will lock the buoyancy tank 2 to the barge 9 when the buoyancy tank 2 is pulled up against the barge 9. This will prevent the buoyancy tank 2 from breaking away during the transportation phase.

Figure 8:
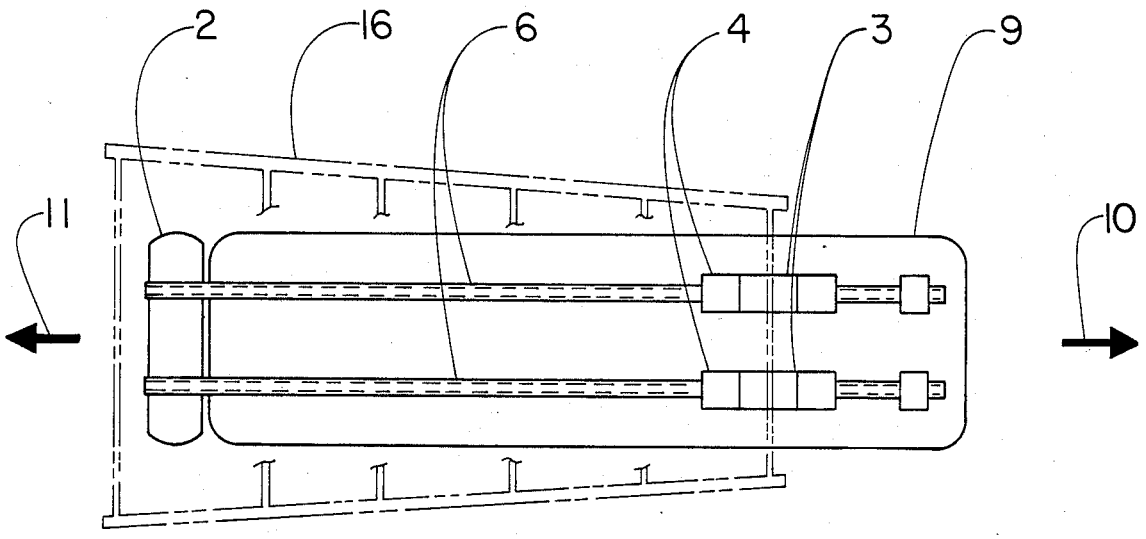
FIG. 8 is a plan view of Embodiment 1 of the present invention showing the marine structure on the deck of the barge.

Referring to FIG. 8 there is shown a plan view of how a large marine structure 16 will be transported on barge 9 and assisted with buoyancy tank 2. The marine structure 16 may extend out over the sides of the barge 9.

Figure 9:
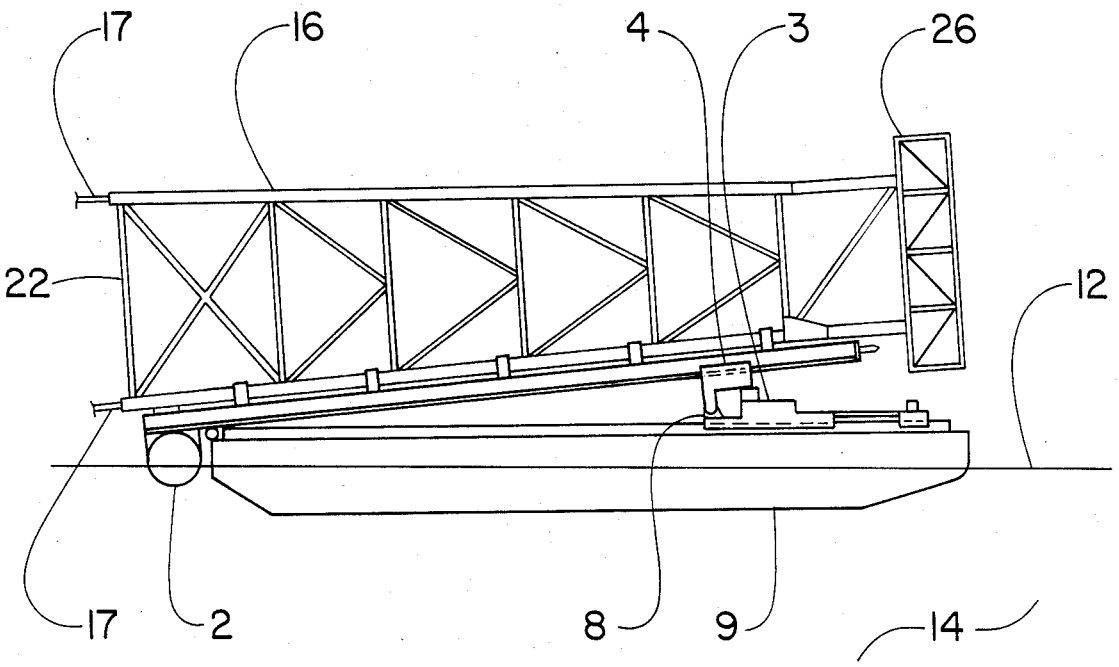
FIG. 9 is an elevation view of Embodiment 1 of the present invention showing the marine structure and deck structure on the deck of the barge.

Referring to FIG. 9 there is shown a marine structure 16 still connected to a deck structure 26. It could be possible to move both structures in one move. In some cases the deck structure 26 may extend far past the forward 10 part of the barge 9.

Figure 10:
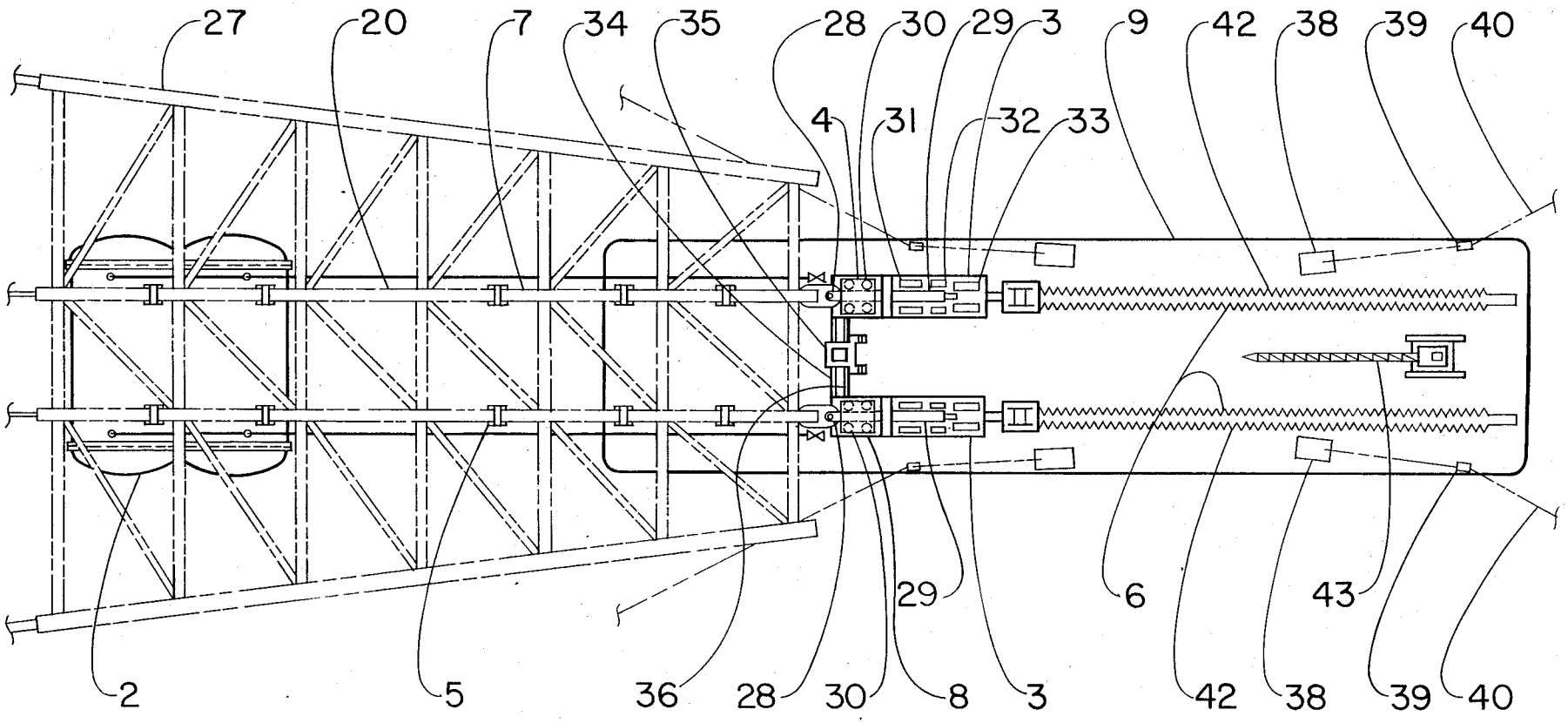
FIG. 10 is a plan view of Embodiment 1 showing more detail of the machinery and the width adjustment rails.

Referring to FIG. 10 there is shown a plan view of the preferred embodiment in greater detail. The structure shown is what is known in the offshore industry as an eight pile jacket structure 27. Also shown being used are a combination of two buoyancy tanks 2. Two or more buoyancy tanks 2 may be required to lift larger jacket structures 16 such as the eight pile jacket structure 27 shown or even greater structures. The grappling arms 7 are located directly below two of the vertical members 20. Also shown on the grappling arms 7 are the grapples 5 which in this case are suitably wrapped around the vertical members 20 this holding the eight pile jacket structure 27 securely to the grappling arms 7.

At the end of the grappling arm 7 is a grappling arm hinge 28 which allows the grappling arms 7 to be adjusted to any angle that the vertical members may have. Said grappling arm 7 is connected to pinion gear 30 by rack gear 29. The pinion gear 30 is part of the inclined jacking unit 4 which is connected by a hinge 8 means to the horizontal jacking unit 3. Placed on the structure of horizontal jacking unit 3 are air compressors 31, hydraulic pumps 32 and generator 33 which power the unit. The air compressors 31 are used to pump air into the buoyancy tanks 2. Fuel tanks not shown and other equipment may be added to the system as required.

Connecting the two horizontal jacking units 3 together is transverse support beam 34 which supports the control house 35 and also supports the inclined jacking units 4 on a transverse rail 36. The transverse rail will allow the inclined jacking unit 4 to move transversely on the barge 9. The ability to move the inclined jacking units 4 transversely on the barge 9 will allow the inclined jacking units 4 to be adjusted to suit the dimension between the vertical members 20 of the marine structures 16. The distance between the vertical members 20 will vary greatly from one marine structure 16 to another marine structure 16 and the transverse rail will allow the inclined jacking units 4 to be accurately adjusted.

The barge 9 may also be outfitted with a suitable mooring system 37 consisting of a winch 38 and a fairleader 39 and anchor lines 40 connected to anchor 41 not shown.

The horizontal jacking unit 3 will run along rails 6 suitably connected to the deck of barge 9. The rails as shown are rack gear rails 42 but could be plate rails not shown or even railroad rails.

The horizontal jacking unit 3 could also be moved along rack gear rail 42, by chains, cables or other means.

Also included on barge 9 is a crane 43 to assist the unit in maintenance, supplies and small lifts onto and off of the jacket structure 16.

Figure 11:
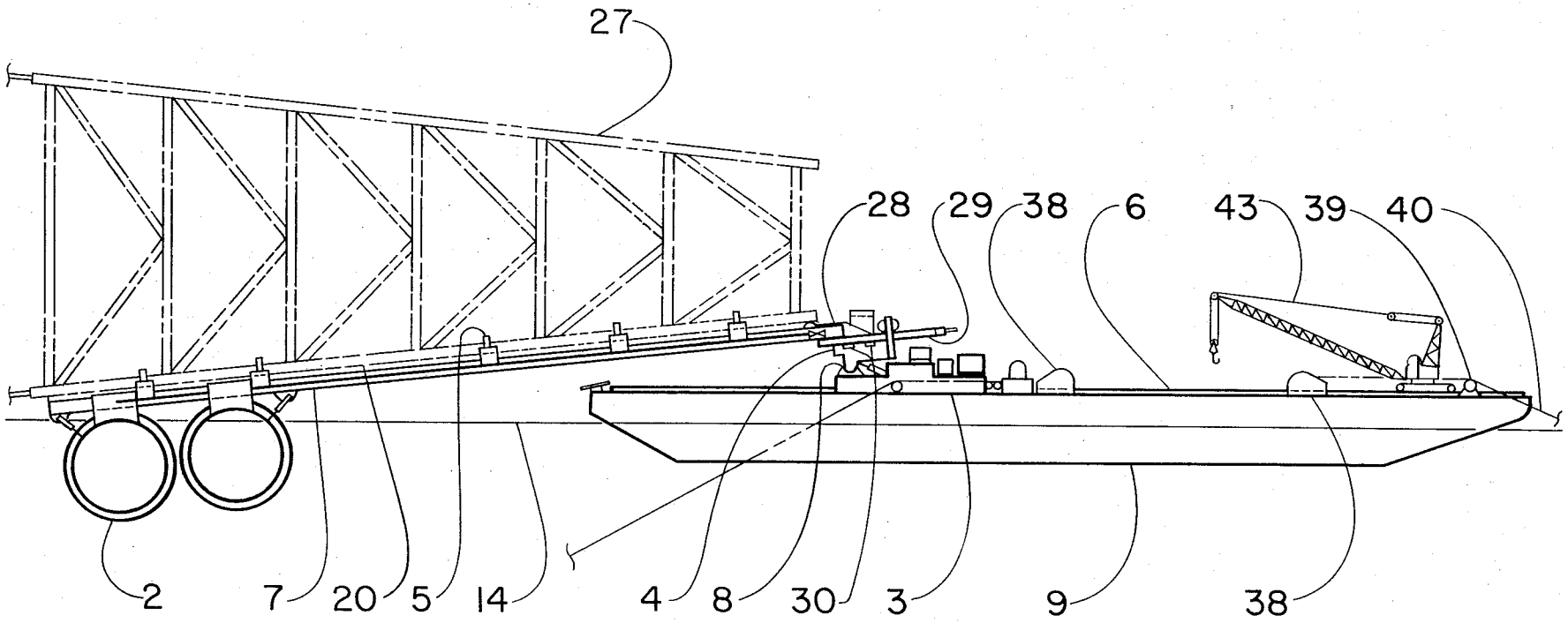
FIG. 11 is an elevation view of embodiment 1 showing the machinery and the longitudinal rails.

Referring to FIG. 11 there is shown an elevation of the eight pile jacket structure 27 being pulled aboard the barge 9. The eight pile jacket structure 27 is connected to the grappling arm 7 by grapples 5 which are suitably wrapped around vertical member 20. At the far end of the grappling arm 7 are buoyancy tanks 2 which are floating in the water 14. The grappling arm 7 is also connected to inclined jacking unit 4 by hinge 8 which is connected to the horizontal jacking unit 3. The horizontal jacking unit 3 runs along rails 6 which are suitably attached to barge 9. Barge 9 is suitably held on location by mooring system 37 which consists of winch 38, fairleader 39, cable 40 and anchor 41 not shown. There can be one or more mooring systems 37 placed on barge 9.

There is also a crane 43 on barge 9 if desired.

Figure 12:
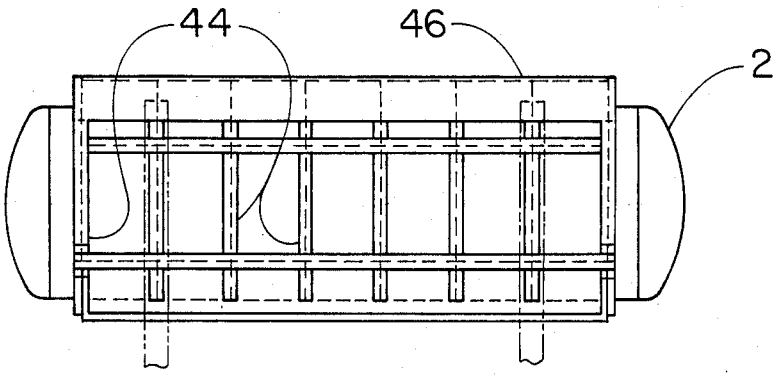
FIG. 12 is a plan view of the buoyancy tank.

Referring to FIG. 12 the buoyancy tank 2 is shown in plan view. The buoyancy tank 2 will be suitably stiffened with ring girders 44 and other suitable stiffeners as required. A double bottom 46 is also added to protect the buoyancy tank 2 from damage on the sea floor 15.

Figure 13:
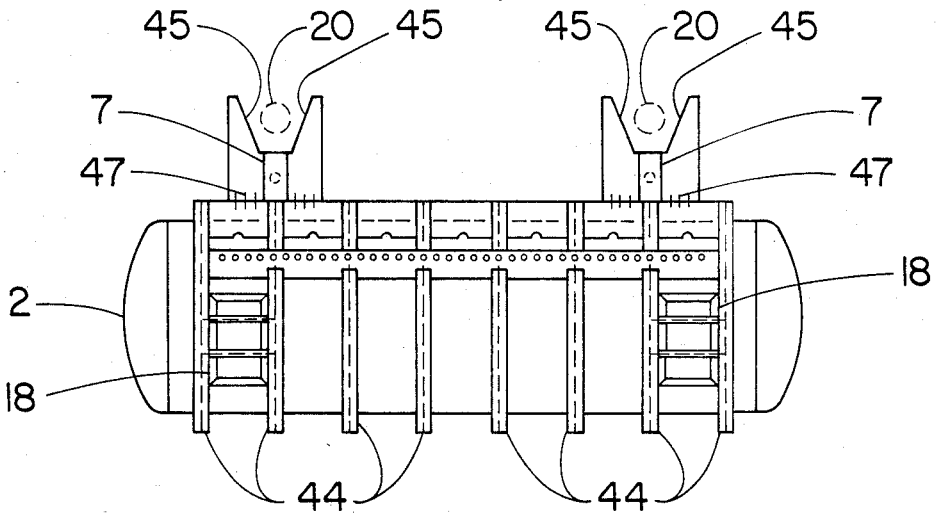
FIG. 13 is an elevation of the buoyancy tank.

Referring to FIG. 13 the buoyancy tank 2 is shown in elevation. The V guides 45 are used to guide the vertical members 26 of the marine structure 16 into a suitable location where the grapplers 5 can grapple the vertical member 20. The ring girders 44 shown can also help to protect the buoyancy tank 2 from damage when it is on the sea floor.

The V guides 45 are part of the grappling arm 7 and are fastened to the buoyancy tank by bolts 47 or other suitable fastening means. The bolts 47 are used to fasten the grappling arm 7 to the buoyancy tank 2 to allow the grappling arms to be moved on the buoyancy tank 2 each time a different size jacket structure is to be moved.

Also connecting the grappling arm 7 to the buoyancy tank 2 is a set of diagonal braces 48. The diagonal braces 48 are also bolted 47 to the buoyancy tank 2 and grappling arm 7.

Suitably attached to the ring girders 44 and buoyancy tank 2 are the directional thrusters 18.

Figure 14:
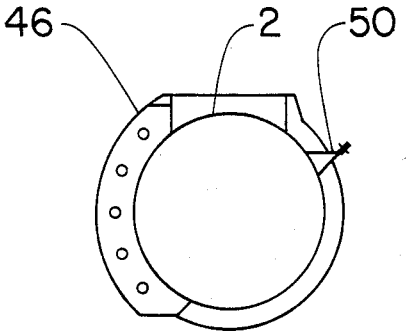
FIG. 14 is sectional view of the buoyancy tank.

Referring to FIG. 14 is a cross section of the buoyancy tank 2 which shows the double bottom 46 which is added to protect the buoyancy tank 2 as it rolls on the bottom. Also shown is the foundation 49 that the grappling arm 7 is bolted 47 to.

Figure 15:
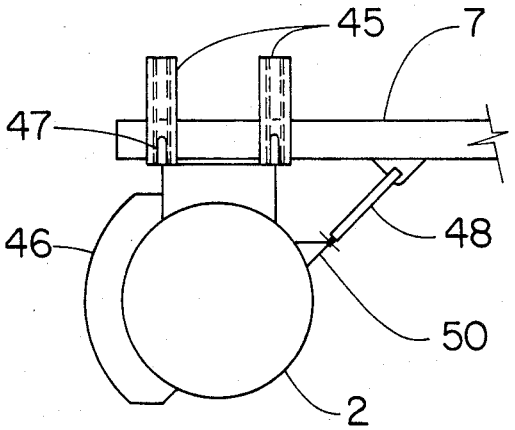
FIG. 15 is a sectional view of the buoyancy tank and the connection with the grappling arm.

Referring to FIG. 15 there is still another cross section shown of the buoyancy tank 2. The grappling arm 7 is suitably fastened to the V guides 45 and the V guides 45 ae bolted to the buoyancy tank foundation 49. Also connecting the grappling arm 7 to the buoyancy tank 2 is the diagonal brace 48 which is suitably attached to the grappling arm 7 at one end and the diagonal brace foundation 50 at the other end.

Figure 16:
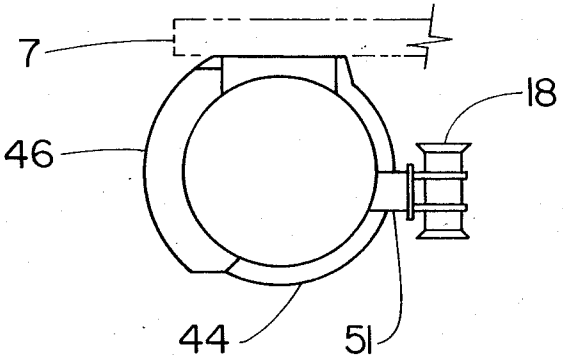
FIG. 16 is a section view of the buoyancy tank showing the thruster units.

Referring to FIG. 16 there is shown still another section of the buoyancy tank 2. This section shows the directional thruster 18 as it is suitably fastened to the thruster foundation 51 which is also suitably fastened to the buoyancy tank 2 and the ring girders 44.

Figure 17:
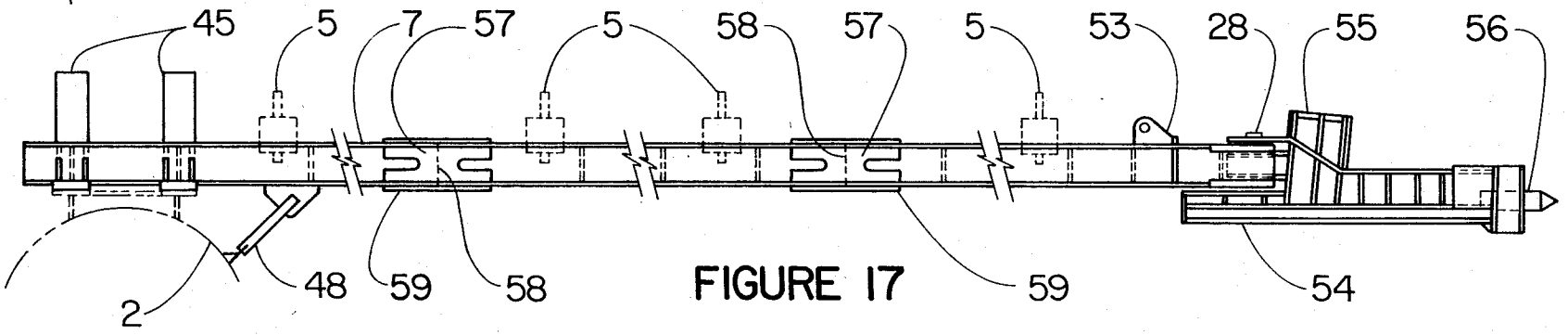
FIG. 17 is an elevation view of the grappling arm.

Referring to FIG. 17 there is shown an elevation of the grappling arm 7 which is attached to the buoyancy tank 2 at one end. Slidably conncted to the grappling arm 7 are the grapples 5. Also connected near the top of the grappling arm 7 is a pad eye 53 that may be required to tie the marine structure 16 in order to pull it over or just to secure the marine structure 16 to the grappling arm with cable for tieing down purposes or for pulling over purposes.

Connecting the grappling arm 7 to the grappling arm rack gear 54 is the grappling arm hinge 28.

Part of the grappling arm rack gear 54 is the grappling arm cradle 55.

In order to make the grappling arm 7 longer or shorter, the grappling arm 7 may be fitted with splice sections 57 or it may be made telescopic which is not shown. The splice sections can be bolted on by splice plates 58 or other suitable means.

Figure 18:
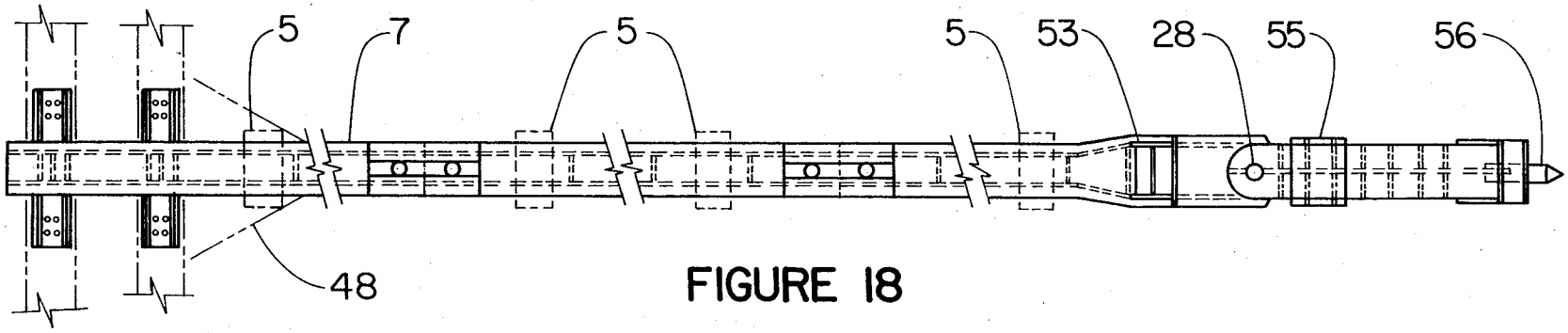
FIG. 18 is a plan view of the grappling arm.

Referring to FIG. 18 there is shown a plan view of the grappling arm 7. The grapplers 5 are as stated above, slidably attached to the grappling arm 7. Also connected at one end of grappling arm 7 is the grappling arm hinge 28 and grappling arm cradle 55.

Figure 19:
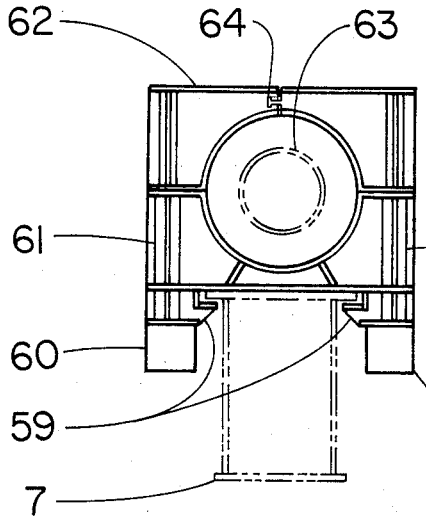
FIG. 19 is an elevation view of the grapples closed.

Referring to FIG. 19 there is shown the grapple 5 in a closed position. The grapple 5 is slidably attached to the grappling arm 7 by slide plates 59 and bolts not shown or other suitable means. The grapplers in this case are rotated into a closed position by the actuator 60. The actuator 60 is suitably connected to actuator shaft 61 which rotates grappling fingers 62 in a clockwise direction or counter clockwise direction.

To make the grapplers 5 into a smaller diameter for smaller diameter vertical members 20 of smaller marine structures 16, inserts 63 may be added or removed by bolting or other suitable means of fastening. The grappling fingers may have a locking device 64.

Figure 20:
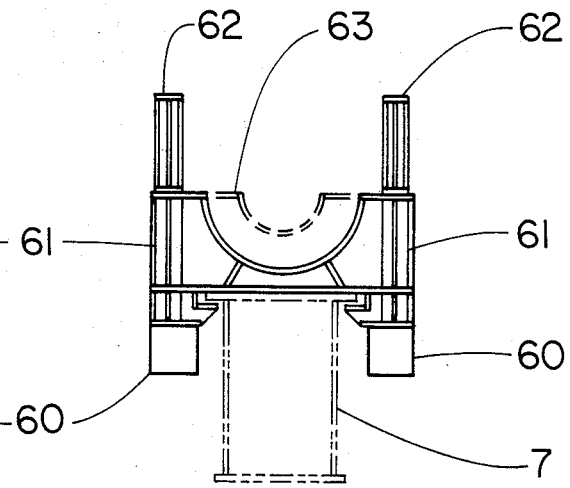
FIG. 20 is an elevation view of the grapples open.

Referring to FIG. 20 there is shown the grappler in an open position where it may receive the vertical member 20 of the jacket structure 16. All other components are the same.

Figure 21:
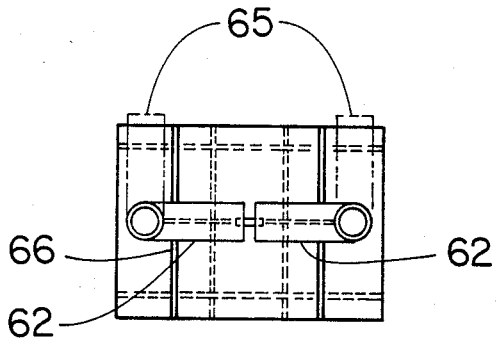
FIG. 21 is a plan view of a grapple.

Referring to FIG. 21 there is shown a plan view of the grapplers 5. The grapplers are shown in a closed position 66 as in FIG. 19. The phantom lines indicate the grappling fingers 62 in an open position 65 as in FIG. 20.

Figure 22:
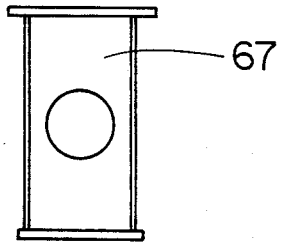
FIG. 22 is a sectional view of the grappling arm.

Referring to FIG. 22 there is shown a cross sectional view of the grappling arm 7 of the preferred embodiment. The grappling arm is a box beam in shape with occasional diaphram plate stiffeners 67. Other types of stiffeners may be required.

Figure 23:
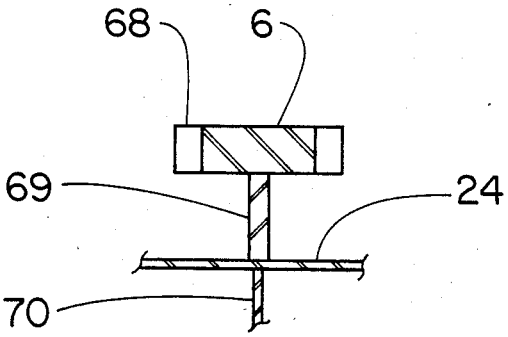
FIG. 23 is a section view of the deck rail.

Referring to FIG. 23 there is shown a cross sectional view of the rail 6 which is also a double rack gear 68 that is suitably mounted on a vertical plate 69 that is also suitably mounted on the deck 24 of the barge 9. It is preferably mounted over a bulkhead 70 that would be inside of the barge 9.

Figure 24:
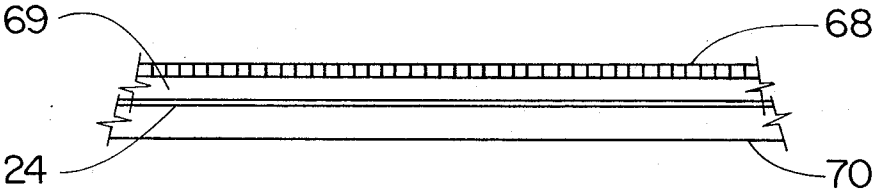
FIG. 24 is an elevation view of the deck rail.

Referring to FIG. 24 there is shown an elevation of the rack gear 68 on the deck 24 of the barge 9.

Figure 25:
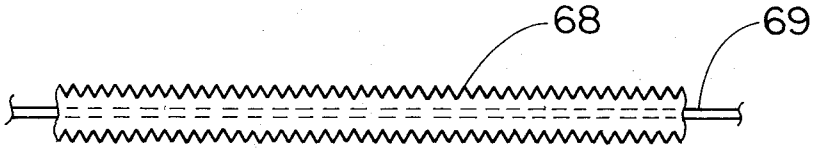
FIG. 25 is a plan view of the deck rail.

Referring to FIG. 25 there is shown a plan view of the rack gear 68 on the deck of the barge 9.

Although the system described in detail supra has been found to be most satisfactory and preferred many variations in structure and method are possible. For example the inclined jacking unit may be placed on the horizontal jacking unit carriage in such a manner that the inclined jacking unit may hinge in the fore and aft direction as shown but may also be inclined in a port and starboard direction or incline to the right and left of the barge which would eliminate the need for the grappling arm hinge. The grappling arm rack gear could run the entire length of the grappling arm. The grappling arm could be square, rectangular, triangular or round in shape. The grappler fingers could be rotated in a perpendicular direction of those fingers shown in the preferred embodiment; the grappling fingers could be moved with hydraulic cylinders or gears or electric motors or hydraulic cylinders. The buoyancy tank may have protective plating all around it. The buoyancy tank may not have to be set on the sea floor to pull the jacket structure over. The grappling arm may not require grapples, only cradles and cables to hold the jacket structure to the grappling arm. The buoyancy tank may have a jetting system on it to jet out the area around the sea floor. The buoyancy tanks may be longitudinal along the grappling arms instead of transverse across the grappling arms. The barge may be one or more cylindrical tanks. The grappling arm may be telescopic. The jacking system that use rack and pinion gears may be replaced with cables and motors, hydraulic cylinders or even friction wheels as a means of propulsion. Pile cutting devices may be added to the bottom of the grappling arms. There may be one, two, three, four or more grappling arms. There may be a locking device between the buoyancy tank and the barge. There may be a means of sliding or rolling a jacket structure off of the construction foundation where it is built and onto the grappling arms or there may be a means of sliding the grappling arms below a newly constructed jacket structure, jacking up the grappling arms or lowering the structure to the position that the grappling arms bear all of the weight of the marine structure. A method may be employed of placing the ends of the grappling arms on a warf, removing the buoyancy tanks and jacking the grappling arms and the marine structures onto land for rework or modification or scrapping. A method may be employed for pulling the marine structure off of the grappling arms in deep water for burial of the marine structure at sea for economic considerations. A system of wheels of archimedean screws may be added to the buoyancy tank or the grappling arm to allow the buoyancy tank to be moved on the sea floor.

The above are examplary of the possible changes or variations.

Because many varying and different embodiments may be made within the scope of the inventive concept herein taught and because many modifications may be made in the embodiment herein detailed, in accordance with the descriptive requirements of law, it should be understood that the details herein are to be interpreted as illustrative and not in a limiting sense.

I claim:

1. A mobile offshore construction device for use in transporting a marine structure in a substantially horizontal position on a barge and setting the marine structure in a vertical position on the sea floor, comprising:

a barge, said barge having means for floating said barge on the surface of the sea;

at least one rail on said barge, said rail lying in a fore and aft direction on the deck of said barge;

a horizontal jacking unit having means for propelling said horizontal jacking unit on said rail in a fore and aft direction substantially along the entire length of said barge;

an inclined jacking unit including hinges, said hinges rotatably connecting said inclined jacking unit to said horizontal jacking unit, whereby said inclined jacking unit rotates in a forward to aft direction;

a grappling arm substantially as long as said barge in the fore and aft direction, said grappling arm slidably attached to said inclined jacking unit;

means for temporarily locking said grappling arm slidably to the marine structure;

at least one buoyancy tank connected to one end of said grappling arm;

means for moving said grappling arm off of said barge to a position fully extended aft of said barge and supported at a first end by said barge and at a second end by said buoyancy tank;

said buoyancy tank having sufficient buoyancy to support part of said grappling arm and part of the marine structure;

said buoyancy tank having means for allowing air to escape, whereby said buoyancy tank becomes only partially buoyant to allow said grappling arm and the marine structure to descend slowly into the sea and said buoyancy tank having means for supporting and cushioning said grappling arm and the marine structure when said grappling arm and the marine structure are set on the sea floor.

2. A method of removing a vertical marine structure from the sea floor and setting the marine structure on a barge in a horizontal position, the barge including at least one buoyancy tank connected to at least one grappling arm equipped with at least one grapple, the grappling arm being movably connected to at least one inclined jacking unit, the inclined jacking unit being connected by a hinge to at least one horizontal jacking unit, the horizontal jacking unit being movably connected to at least one horizontal rail mounted substantially along the entire length of the deck of the barge, comprising the steps of:

A. Extending the grappling arm fully behind the barge such that it is supported on the sea surface at one end of the grappling arm by the buoyancy tank and at the other end of the grappling arm by the barge with substantially the entire length of the grappling arm over the surface of the sea;

B. Lowering the grappling arm by the buoyancy tank to the sea floor;

C. Locating the grappling arm near the marine structure;

D. Placing the grapples around a structural member of the marine structure;

E. Pulling the marine structure over at an angle;

F. Filling the buoyancy tank with air to allow the buoyancy tank to raise itself, the grappling arm and the marine structure to the surface of the sea;

G. Pulling the marine structure out of the sea and onto the barge with the horizontal jacking unit.

3. The method of claim 2, wherein the buoyancy tank is lowered near the sea floor.

4. The method of claim 2, wherein the buoyancy tank is rolled on the sea floor supporting the weight of the marine structure.

5. The method of claim 2 wherein step C includes the step of locating the buoyancy tank and the grappling arm at the marine structure by means of thrusters.

6. The method of claim 2 wherein step C includes the step of locating the buoyancy tank at the marine structure by means of divers' assistance.

7. A method of removing a horizontal marine structure from a barge and setting the marine structure in a vertical position on the sea floor, the barge including at least one buoyancy tank, connected to at least one grappling arm equipped with at least one grapple, the grappling arm being movably connected to at least one inclined jacking unit that is connected by a hinge to at least one horizontal jacking unit that is movably connected to at least one horizontal rail mounted substantially along the entire fore/aft length of the deck of the barge, comprising of the steps of:

A. transporting the marine structure to the erection location while the marine structure is resting substantially along the entire fore/aft length of the barge deck in the horizontal position on the grappling arms;

B. pushing the marine structure off of the barge so that the marine structure fully extends on the surface of the sea aft of the barge with some of the weight of the marine structure bearing on the buoyancy tank and some of the weight of the marine structure bearing on the barge;

C. flooding the buoyancy tank with water causing the buoyancy tank and the grappling arm and the marine structure to sink until the buoyancy tank sets on the sea floor;

D. positioning the marine structure into an upright position on the sea floor;

E. releasing the grapple from the marine structure;

F. pulling the grappling arm and the buoyancy tank away from the marine structure;

G. refloating the buoyancy tank and the grappling arm until they are fully extended on the surface of the sea aft of the barge by pumping air into the buoyancy tank;

H. pulling the grappling arm onto the barge with the horizontal jacking unit.

* * * * *